US012031747B1

(12) United States Patent
Mefford et al.

(10) Patent No.: US 12,031,747 B1
(45) Date of Patent: Jul. 9, 2024

(54) CHILLING UNIT FOR EVAPORATIVE AIR CONDITIONING UNITS

(71) Applicant: Combo-Cool, LLC, Rio Rancho, NM (US)

(72) Inventors: Mark Mefford, Rio Rancho, NM (US); John Odell, Rio Rancho, NM (US); Timothy Allan Cushman, Sandia Park, NM (US); John David Harry Harris, Cedar Crest, NM (US)

(73) Assignee: Combo-Cool, LLC, Rio Rancho, NM (US)

( * ) Notice: Subject to any disclaimer, the term of this patent is extended or adjusted under 35 U.S.C. 154(b) by 0 days.

(21) Appl. No.: 17/728,158

(22) Filed: Apr. 25, 2022

Related U.S. Application Data

(60) Provisional application No. 63/182,460, filed on Apr. 30, 2021.

(51) Int. Cl.
*F24F 5/00* (2006.01)
*F24F 1/0097* (2019.01)
(Continued)

(52) U.S. Cl.
CPC ..... *F24F 5/0035* (2013.01); *F24F 1/0097* (2019.02); *F24F 5/0042* (2013.01);
(Continued)

(58) Field of Classification Search
CPC ..... F24F 5/0035; F24F 5/0042; F24F 1/0097
See application file for complete search history.

(56) References Cited

U.S. PATENT DOCUMENTS 3,366,164 A * 1/1968 Newton ..... F24F 5/0042 62/3.2
4,312,819 A * 1/1982 Leyland ..... F24F 6/04 261/36.1

(Continued)

FOREIGN PATENT DOCUMENTS

CN 202066138 U 12/2011
CN 109458684 A 3/2019

(Continued)

OTHER PUBLICATIONS

"Enhanced air-cooled chiller performance with evaporative cooling", https://www.kaltra.com/single-post/2018/04/29/evaporative-adiabatic-chillers, Apr. 29, 2018.

*Primary Examiner* — Jerry-Daryl Fletcher
*Assistant Examiner* — Daniel C Comings
(74) *Attorney, Agent, or Firm* — Peacock Law P.C.; Justin R. Muehlmeyer; Rod Baker

(57) ABSTRACT

A chilling system for reducing the temperature of water used in an evaporative air conditioning unit (EAC) to increase its efficiency and efficacy. The chilling system is integrated within a frame for convenient and secure retrofit to the EAC. Water is pumped into the chilling system via a water supply line from the EAC. When the temperature of the water in the water supply line is above a preset high temperature, the power supply turns on the thermoelectric chilling device to remove heat from coolant, which coolant passes through the heat exchanger to remove heat from the water passing through the heat exchanger. The water, now cooled, is discharged back into the reservoir of the EAC. This cycle continues until the temperature sensor indicates that the temperature of the water has fallen below a preset low temperature, at which point the power supply turns off the thermoelectric chilling device.

15 Claims, 12 Drawing Sheets

(51) Int. Cl.

| | |
|---|---|
| ***F24F 11/30*** | (2018.01) |
| ***F25B 7/00*** | (2006.01) |
| ***F28D 5/00*** | (2006.01) |
| *F24F 110/10* | (2018.01) |
| *F24F 110/20* | (2018.01) |
| *F24F 140/20* | (2018.01) |

(52) U.S. Cl.
CPC ..... *F24F 11/30* (2018.01); *F28D 5/00* (2013.01); *F24F 2110/10* (2018.01); *F24F 2110/20* (2018.01); *F24F 2140/20* (2018.01); *F25B 7/00* (2013.01)

(56) References Cited

U.S. PATENT DOCUMENTS

| | | | | |
|---|---|---|---|---|
| 5,555,732 | A * | 9/1996 | Whiticar | F24F 3/14 62/93 |
| 6,053,004 | A * | 4/2000 | Beppu | F24F 5/0007 62/262 |
| 7,207,182 | B1 | 4/2007 | Schoonover et al. | |
| 11,073,335 | B1 | 7/2021 | Staniulis | |
| 2006/0010893 | A1* | 1/2006 | Dominguez | F24F 11/74 62/201 |
| 2007/0227171 | A1 | 10/2007 | McMillan et al. | |
| 2014/0250935 | A1 | 9/2014 | Prochaska et al. | |
| 2016/0069575 | A1* | 3/2016 | Anderson | F24F 3/147 62/304 |
| 2020/0149756 | A1 | 5/2020 | Tang et al. | |
| 2021/0254867 | A1* | 8/2021 | Swofford | F25B 21/02 |

FOREIGN PATENT DOCUMENTS

| | | | | |
|---|---|---|---|---|
| CN | 112665053 | A | 4/2021 | |
| WO | WO-2012006436 | A2 * | 1/2012 | F24F 11/30 |
| WO | 2019150151 | A1 | 8/2019 | |

* cited by examiner

CHILLING UNIT FOR EVAPORATIVE AIR CONDITIONING UNITS

CROSS-REFERENCE TO RELATED APPLICATIONS

This application claims priority to and the benefit of U.S. Provisional Patent Application No. 63/182,460, entitled "Chilling Unity for Evaporative Air Conditioning Units", filed on Apr. 30, 2021, and the specification thereof is incorporated herein by reference.

BACKGROUND OF THE INVENTION

Field of the Invention

Embodiments of the present invention relate to devices that enhance the efficiency or efficacy of evaporative air conditioning systems.

Background Art

Evaporative air conditioning units, sometimes known as "swamp coolers" (referred to herein as "EACs") provide cool air by passing hot air from the outside of the unit ("outside air") through a pad or series of pads moistened with water. The water in the moistened pad of the EAC absorbs the heat in the outside air and evaporates, thereby producing a cooler air within the EAC ("cooled air"), which is then distributed throughout the vents of the air-conditioned facility. EACs are known to produce cooled air that is, on a national average, eighteen degrees cooler than the outside air temperature. However, humidity drastically affects the ability of EACs to work efficiently as well as the human perception that the facility has been air conditioned, particularly if the humidity of the outside air is above about forty percent. Humidity is such a problem for EACs that EACs are predominantly only used in dry, hot and low-humidity regions. Even in those regions, some days can be more humid than others, causing a very noticeable decrease in the efficacy and/or efficiency of the EAC. What is needed is a system that addresses this problem of humidity to increase the efficacy and efficiency of EACs.

The cooler the water used by the EAC to moisten the pads, the lower the air temperature of the cooled air. However, the water used by existing EACs is often even hotter than tap water, being unintentionally heated above the temperature of tap water from the facility because the water is often provided to the EAC through a long tube on the roof of the facility that is exposed to extreme temperatures and direct sun exposure. What is needed is a system for chilling the water employed by an EAC at or near the EAC itself, to avoid any significant heating of the water caused by sun exposure.

EACs are an old technology that is unlikely to change. Most consumers replace their EACs only very rarely, perhaps every ten to thirty years or when the facility is sold. Any new EAC technology should be easily adapted to existing EACs and their power and water availability because consumers of EACs are not interested in the expense and trouble of adding new power or water lines to their EAC. The water for an EAC (used to moisten its pads) is typically provided from a tap to the water supply of the facility ("water supply"), for example, a tap of the cold water intake on the water heater in the garage of a residence. The electrical power supply for an EAC is a typical household plug made available at or near the location of the EAC (very often on the roof). What is needed in any system that addresses the humidity problem of EACs is a system that retrofits to existing EACs without requiring any new water or power input not already provided to existing EACs.

BRIEF SUMMARY OF EMBODIMENTS OF THE PRESENT INVENTION

Embodiments of the present invention are directed to methods and systems for chilling the water used by an EAC to improve its efficacy, reduce the inefficiencies caused by humidity and to provide enhanced capabilities that automate adjustments to operation based on conditions. A primary object of the present invention is to provide a modular unit to be retro-installed to existing EACs that chills the water supply to the EAC, thereby further decreasing the temperature of the cooled air beyond what is normally obtainable by an EAC.

Embodiments of the present invention are directed to a chilling unit system for evaporative air conditioning units, the chilling unit system including: a frame, the frame comprising a bottom side and a top side opposite the bottom side; a power supply; a water supply line capable of supplying water from a water reservoir or water pump of an evaporative air conditioning unit; at least one heat exchanger in fluid connection with the water supply line; at least one chiller in fluid connection with the heat exchanger and in electrical connection with the power supply; a water output line in fluid connection with the at least one chiller and capable of directing water out of the frame; and the power supply, at least one heat exchanger and at least one chiller being contained at least partially within the frame. In another embodiment, the chiller is a thermoelectric cooling device employing the Peltier effect. In another embodiment, a temperature sensor is disposed at, near or on the water supply line, capable of detecting the temperature of the water within the water supply line and in electrical connection with the power supply, the power supply capable of turning on the power supply when the temperature of the supply water is above a first preset temperature and of turning off the power supply when the temperature is below a second preset temperature. In another embodiment, the frame includes an air vent at or near the heat exchanger. In another embodiment, the frame includes an interface sized to receive the water supply line. In another embodiment, the frame includes an interface sized to receive a power cable in electrical connection with the power supply. In another embodiment, the system further comprises at least one wall contained entirely within the frame and extending between the bottom side and top side. In another embodiment, a temperature sensor is disposed at, near or on the water supply line ("supply sensor"), capable of detecting the temperature of the water within the water supply line and in electrical connection with the power supply; a temperature sensor is disposed at, near or on the water output line ("output sensor"); an ambient air temperature and/or humidity sensor is disposed external of the frame ("ambient sensor"); a control system is capable of receiving data from the supply sensor, the output sensor and ambient sensor, and capable of increasing or decreasing the power supply to the at least one chiller based on the difference in temperature between the supply sensor and output sensor, and the frame comprises an interface sized to receive the water supply line, an air vent, and an interface sized to receive a power cable in electrical connection with the power supply; and the chiller is a thermoelectric cooling device. In another embodiment, there is additionally a coolant reservoir and coolant pump in fluid connection with the at least one chiller, the at least one heat exchanger and a radiator. In another embodiment, the coolant comprises glycol fluid. In another embodiment, the frame includes an interface on its bottom side of a size to receive the water supply line; the frame comprises an air vent on its bottom side; the frame comprises an interface on its bottom side of a size to receive a power cable in electrical connection with the power supply; and the chiller is a thermoelectric cooling device employing the Peltier effect. In another embodiment, the frame has a first side, second side, third side and fourth side; the power supply is disposed adjacent to the first side of the frame; the at least one heat exchanger is disposed adjacent to the second side of the frame; the at least one chiller is disposed adjacent to the fourth side of the frame; the frame comprises a first wall extending from the second side to the fourth side of the frame, thereby forming a compartment containing the power supply between the first wall and the first side; and the frame comprises a second wall extending from the third side of the frame to the first wall, thereby forming a compartment containing the at least one heat exchanger and coolant reservoir and pump between the second wall and second side and forming a compartment containing the at least one chiller between the second wall and fourth side. In another embodiment, the at least one chiller is in fluid connection with the water supply line, and the chilling unit system further comprises a water block in fluid connection with the water supply line, the at least one heat exchanger and the at least one chiller, the water block comprising a plurality of internal channels allowing the water to go back and forth within it. In another embodiment, there is at least one fan disposed at or near the heat exchanger and water block.

Embodiments of the present invention are directed to a method of chilling water for use by evaporative air conditioning units, the method including the steps of: supplying water through a water supply line from a water reservoir or water pump of an evaporative air conditioning unit into a heat exchanger; cooling the water using a thermoelectric cooling device in fluid connection with the heat exchanger, the thermoelectric device in electrical connection with a control system that increases or decreases a power supply to the thermoelectric cooling device based on the difference in temperature between the temperature sensed by a temperature sensor in or on the water supply line and a temperature sensor in or on a water discharge line, and wherein the power supply, heat exchanger and thermoelectric cooling device are contained at least partially within a frame; and discharging the cooled water into the water reservoir of the evaporative air conditioning unit through the water discharge line. In another embodiment, the method also includes the step of turning off the thermoelectric cooling device when the temperature sensed by the temperature sensor falls below a second preset temperature. In another embodiment, the frame is disposed on the evaporative air conditioning unit and the frame comprises interfaces for the water supply line, water discharge line, air vent and a power supply cable. In another embodiment, the step of cooling the water further comprises providing coolant to the thermoelectric cooling device and heat exchanger from a coolant reservoir, the coolant comprising glycol liquid.

Embodiments of the present invention are also directed to a method of retrofitting an evaporative air conditioning unit with a chilling unit system, the method including the steps of providing a chilling unit system comprising: a frame, the frame comprising a bottom side and a top side opposite the bottom side; a power supply; a water supply line capable of supplying water from a water reservoir or water pump of an evaporative air conditioning unit; a heat exchanger in fluid connection with the water supply line; a thermoelectric cooling device in fluid connection with the heat exchanger and in electrical connection with the power supply, wherein the power supply, heat exchanger and thermoelectric cooling device are contained at least partially within the frame; connecting the water pump in the reservoir of the evaporative air conditioning unit to the water supply line, through an interface on the bottom side of the frame; directing a water output of the heat exchanger to the water reservoir of the evaporative air conditioning unit, through an interface on the bottom side of the frame; connecting the power supply via a cable to a power source on the evaporative air conditioning unit, through an interface on the bottom side of the frame; and disposing the frame on the evaporative air conditioning unit such that the bottom side of the frame faces or is in contact with a surface of the evaporative air conditioning unit. In another embodiment, a control system increases or decreases the power supply to the thermoelectric cooling device based on the difference in temperature between the temperature sensed by a temperature sensor in or on the water supply line and a temperature sensor in or on or near the water output.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

DETAILED DESCRIPTION OF THE INVENTION

Figure 1:
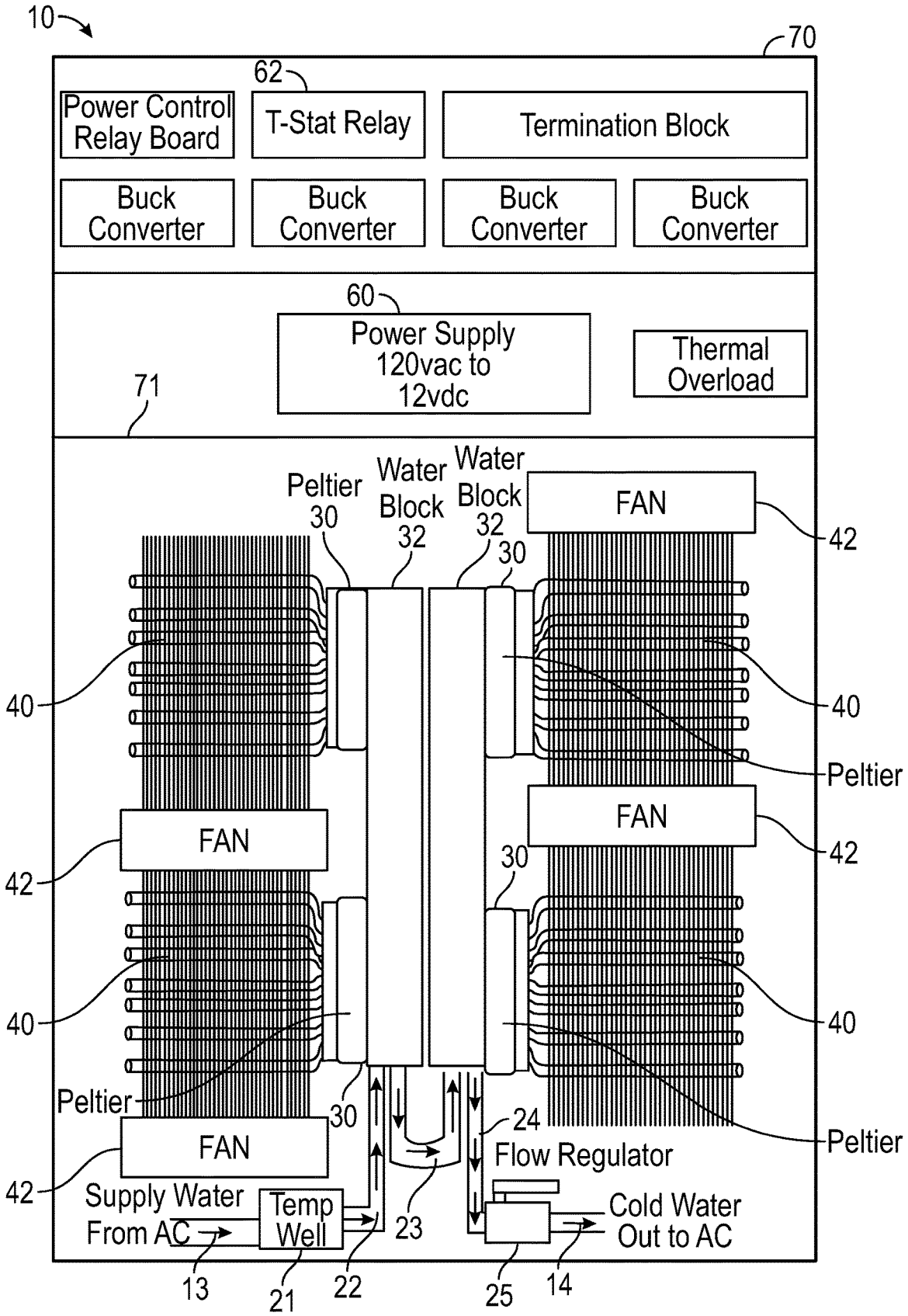
FIG. 1 is a schematic illustration showing the various components and direction of flow of water in a chilling unit 10 according to an embodiment of the present invention.
Figure 2:
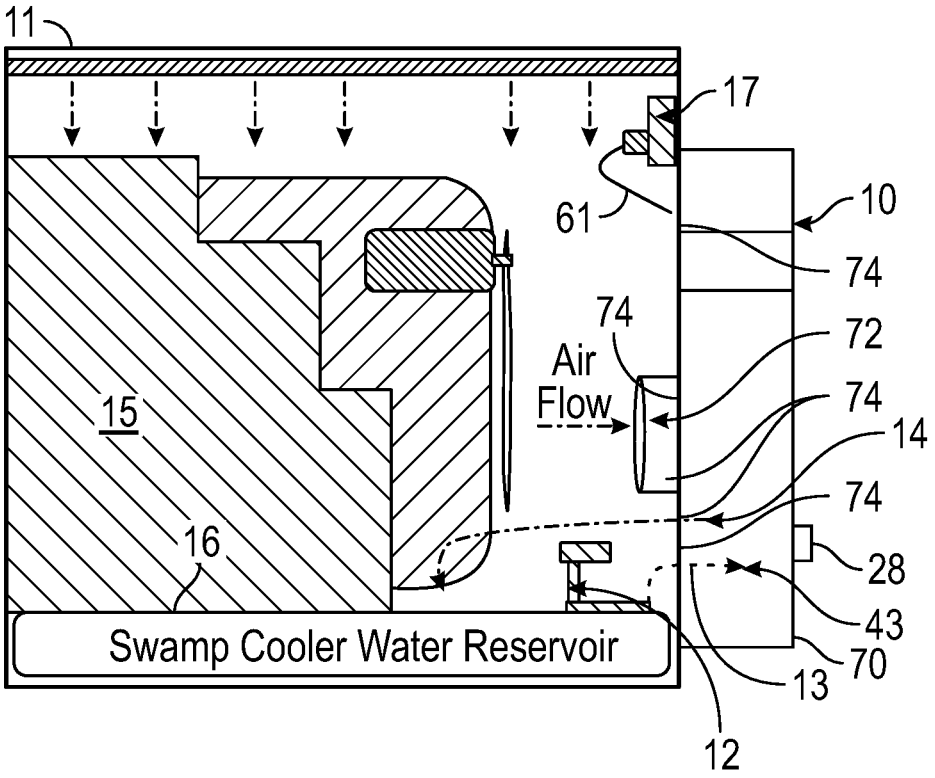
FIG. 2 is a schematic illustration showing an example of how a chilling unit 10 retrofits and operates with an EAC 11 according to an embodiment of the present invention in which the chilling unit 10 is retrofit to the side of the EAC 11.
Figure 3:
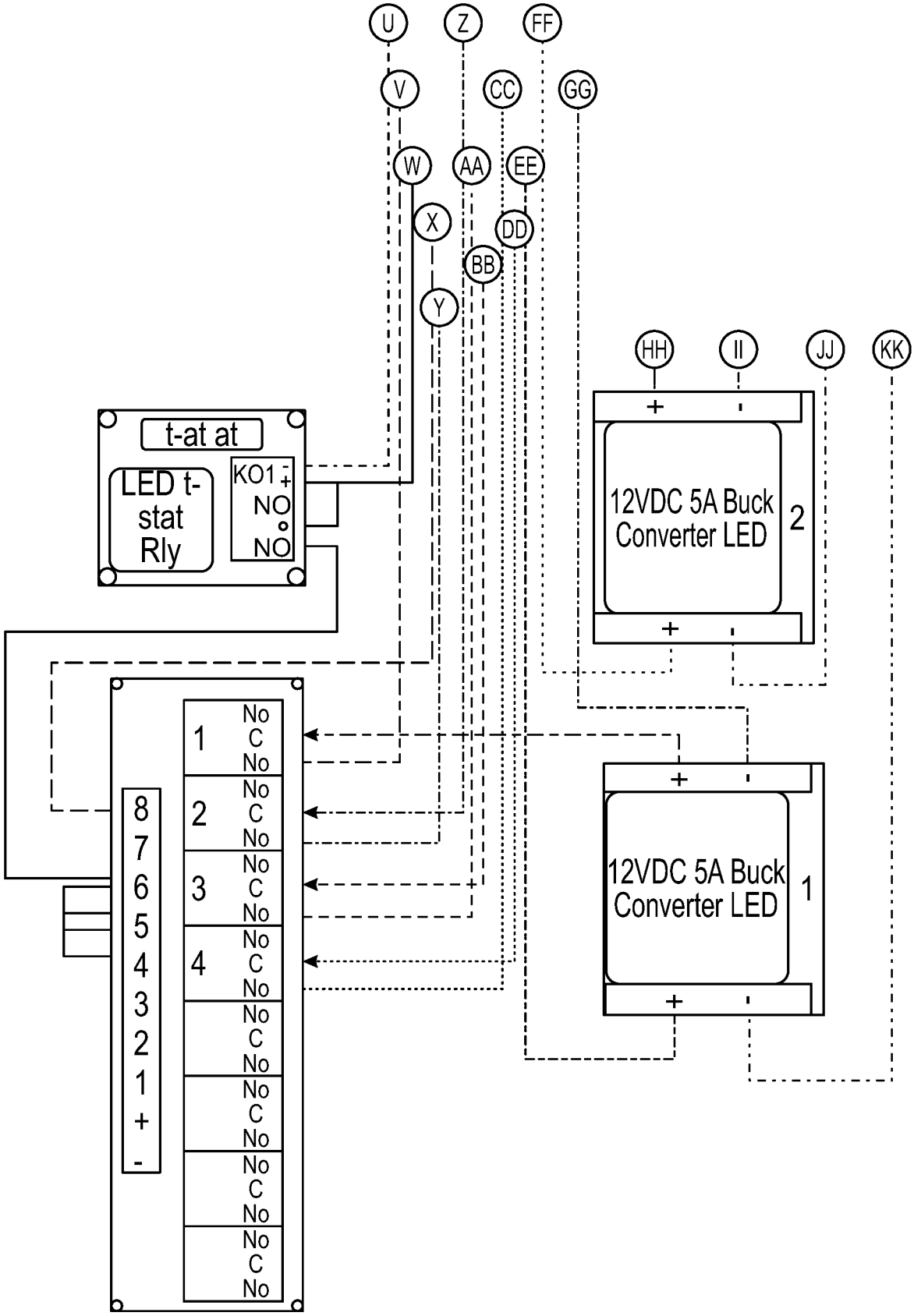
FIG. 3 is an electrical diagram of a chilling unit 10 illustrated in FIG. 1, according to an embodiment of the present invention.
Figure 3:
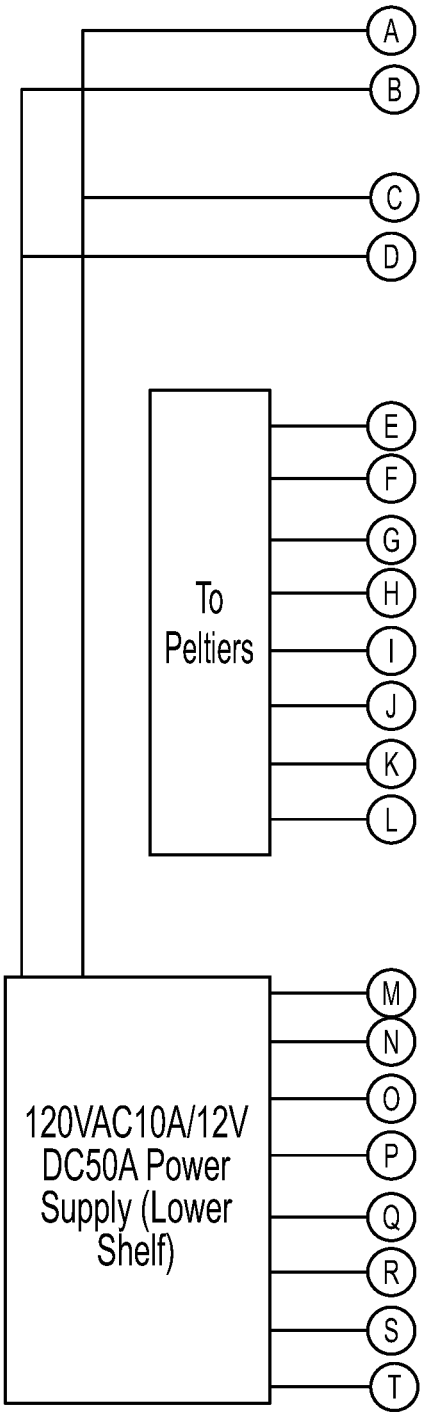
Figure 3:
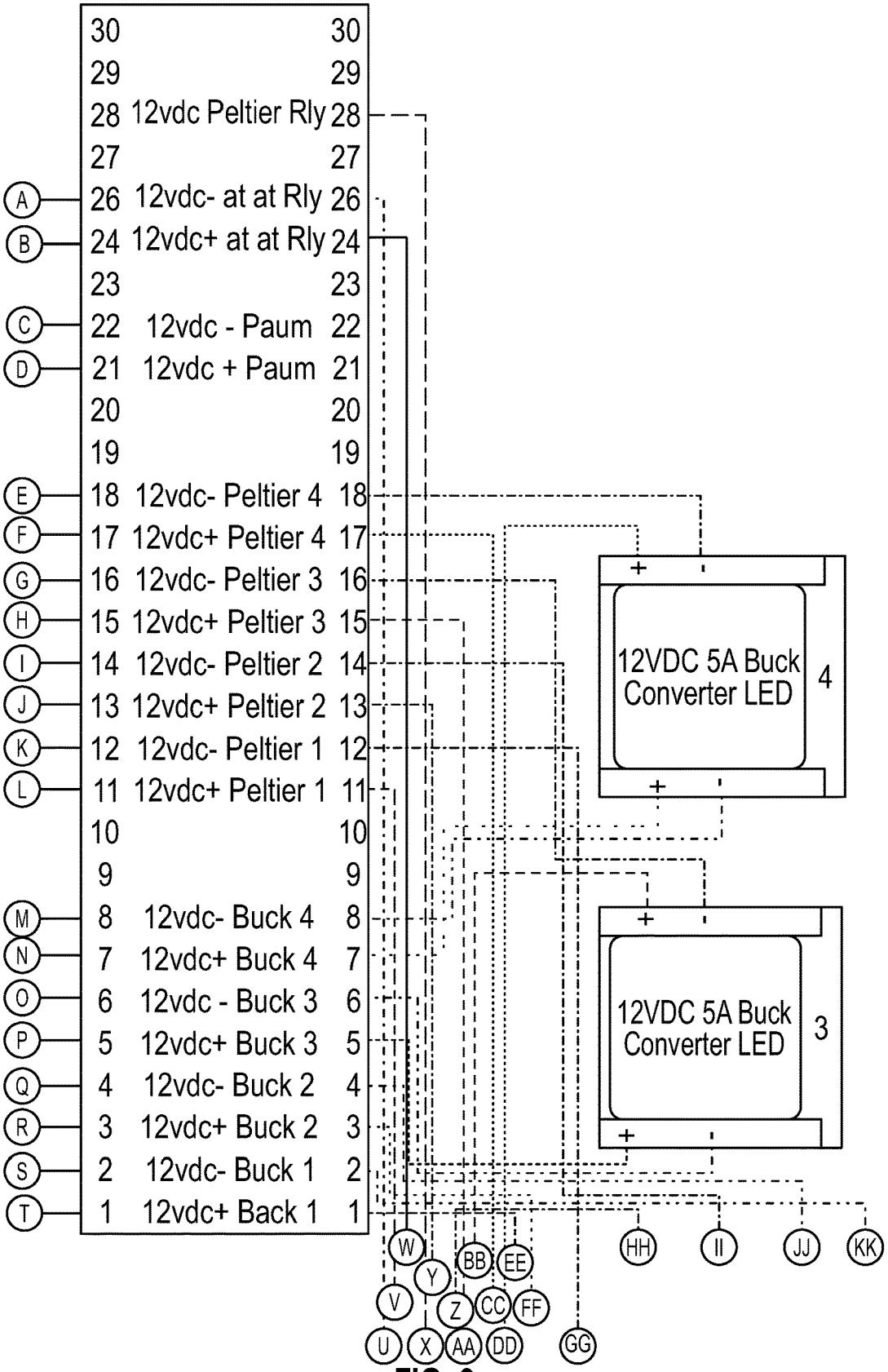

Two different embodiments of the present invention are described and illustrated herein, FIGS. 1-3 illustrating one embodiment that does not employ coolant and FIGS. 4-7 illustrating a different embodiment employing coolant. It should be noted that many of the features described herein are interchangeable between the different embodiments. Accordingly, any feature described or illustrated of any one embodiment should be considered incorporated into the description of the other embodiment if such feature is also present in the other embodiment or could be present in the other embodiment. Any feature or reference number of one embodiment corresponding to a feature or reference number of the other embodiment shall be deemed to include everything described or illustrated about that feature or reference number of the other embodiment.

Embodiments of the present invention are directed to chilling unit 10 that retrofits to an evaporative air condition unit ("EAC") 11 or that is free standing relative to EAC 11 but which connects to the EAC in the various ways described herein.

Referring to FIG. 1, chilling unit 10 preferably comprises at least one water block 32, at least one chiller 30, at least one heat sink 40, and at least one fan 42. Chilling unit 10 also preferably comprises power supply 60, the power source for power supply 60 preferably being the existing power outlet 17 located at, near or within the EAC.

When powered on, water stored in the existing reservoir 16 of EAC is pumped by EAC water pump 12 via supply water line 13 into chilling unit 10, as illustrated in FIG. 2. Preferably, supply water line 13 is connected to the output side of EAC water pump 12. Referring to FIG. 1, temperature well 21, preferably comprising a thermistor or other temperature sensor disposed at or near where supply water line 13 enters chilling unit 10 and connected to temperature relay 62, monitors the temperature of the water in supply water line 13 and is preferably wired into temperature relay 62. Temperature relay 62 is activated when temperature well 21 does not meet a pre-set minimum temperature, thereby energizing chillers 30 by power supply 60. Temperature relay 62 preferably comprises a single pole single throw relay (SPST) or other relay capable of multiple states. After leaving or passing temperature well 21, the water passes through line 22 into water block 32. Water block 32 preferably comprises a solid aluminum structure comprising a plurality of internal channels allowing the water to go back and forth within it, including but not limited to a radiator. Each water block 32 is preferably attached to or otherwise comprises water lines connected with, at least one chiller 30. As the water moves through water blocks 32, it is cooled. This process is repeated until the water temperature is below a preset temperature. Once the temperatures meets that preset temperature, temperature relay 62 changes status and turns off chillers 30. Temperature sensors connected to temperature relay 62 are preferably disposed at or near where supply water line 13 enters chilling unit 10 (for example, temperature well 21) and disposed at or near water blocks 32, including in water blocks 32, water lines 23 and 24 and/or at or near flow regulator 25. Preferably, chilling unit 10 comprises flow regulator 25 connected to water block 32 by line 24 to control the amount of chilled water leaving chilling unit 10 into output water line 14 and back into EAC 11. Preferably, output water line 14 is disposed in or above EAC reservoir 16. That chilled water simply falls into the water reservoir 16 of EAC 11 to be used to moisten media 15. Preferably, water flows through chilling unit 10 even when power supply 60 is not energizing chillers 30.

Each chiller 30 preferably comprises a device capable of cooling/chilling liquids or otherwise removing heat from liquids (note that the word "cooling" is used interchangeably herein with "chilling"), whether the liquid is water or some other coolant. Preferably, chiller 30 employs electricity to cool water received from water block 32, including but not limited to thermoelectric cooling devices, including those devices that employ the Peltier effect, other heat pumps, thermoelectric batteries, solid state refrigerators, etc., but chiller 30 can comprise other devices capable of cooling liquids powered by other energy sources, including gas. Chiller 30 is preferably powered by electricity because electrical power is already available from a typical EAC. As water is chilled by chillers 30, heat sink 40 is heated. Preferably, heat sinks 40 are cooled by air passing over them as provided by fans 42. The air produced by fan 42 removes heat from heat sink 40, which air is removed from chilling unit 10 via air vents disposed on or within frame 70 of chilling unit 10. As water moves through water block 32, it is cooled and leaves the water block cooler than when it entered. Preferably, chilling unit 10 comprises a series of water blocks 32, chillers 30, heat sinks 40 and fans 42, the number of series of which to be determined based on the desired size of the chilling unit 10, size of the EAC and required water temperature. Water lines 23 may connect the various series of water blocks 32.

Frame 70 preferably comprises interfaces 74 allowing the egress and ingress of air into chilling unit 10 and/or allowing various lines to enter chilling unit 10. In one embodiment, frame 70 comprises vents disposed on or within frame 70 at or near where fans 42 are located or on an opposite side from where fans 42 are located, to allow air heated by heat sink 40 to escape chilling unit 10 and/or to allow air to enter chilling unit 10. Referring to FIG. 2, chilling unit comprises vent 72 disposed on or within the side of frame 70 that is in contact with EAC 11, located on that side in the path of air flow from the fan of EAC 11. In one embodiment, a hole of about five to about twenty centimeters in diameter is installed in EAC 11 to allow duct work from EAC 11 for vent 72. Referring to FIG. 2, frame 70 also preferably comprises interfaces allowing the ingress and egress of cable 61 connecting the power source of the EAC with power supply 60, and also interfaces for supply water line 13 and output water line 14, which may be the same interface or two different interfaces. In one embodiment, chilling unit 10 comprises two holes of about one half of a centimeter to about ten centimeters in diameter for supply water line 13 and output water line 14. Any interface described herein, including interfaces 74, preferably comprises a hole with a seal including but limited to rubber O-rings. In some embodiments, the interfaces comprise a valve and/or plug.

Due to the fact that EACs may be oriented or placed on the ground or roof in ways that limit where chilling unit 10 can be attached to it, various ways of mounting/retrofitting chilling unit are described herein. In one embodiment, chilling unit 10 is disposed to EAC 11 on a side of EAC 11, as illustrated in FIG. 2. In another embodiment, chilling unit 10 is disposed to EAC 11 on top of EAC 11, as illustrated in FIG. 5.

To aid in modularity, chilling unit 10 preferably comprises walls 71 to separate and support the various components of chilling unit 10. Preferably, walls 71 are formed of a rigid material, including but not limited to metal, metal alloys, wood, foam, plastic, etc., so that components may be secured to it and/or it can hold its structure under the weight of the components or if shaken.

FIG. 3 is a schematic diagram of the preferred electrical connections of the chilling unit 10 illustrated in FIGS. 1 and 2. Preferably, power supply 60 comprises about a 120 vac 5 amp input converted to 12 vdc 40 amp output. Preferably, the power requirements for chilling unit 10 does not exceed what the power outlet 17 disposed at, near or within EAC 11 can provide.

Figure 4:
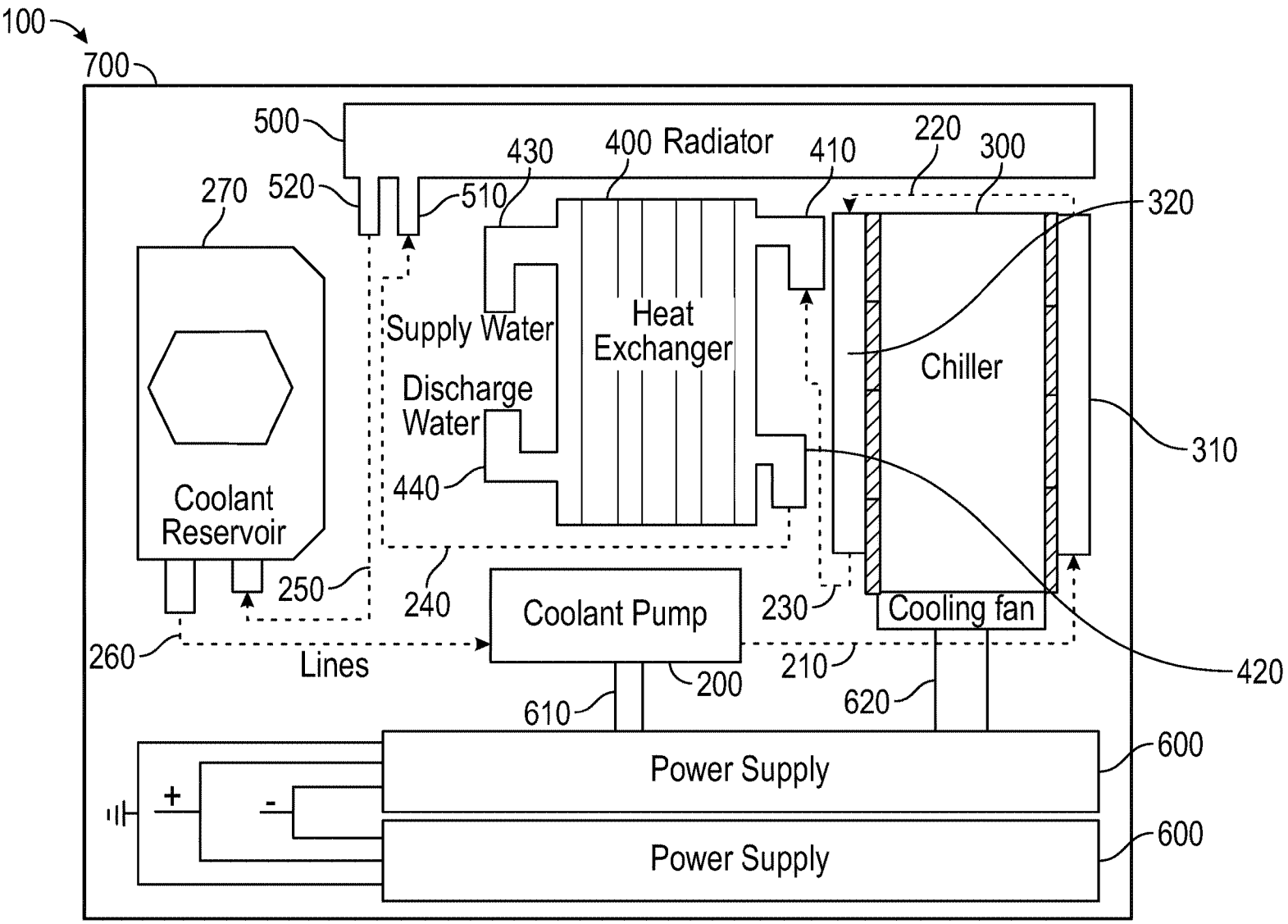
FIG. 4 is a schematic illustration showing the various components and direction of flow in a chilling unit 100 employing coolant to cool water supplied by an EAC, according to an embodiment of the present invention.
Figure 5:
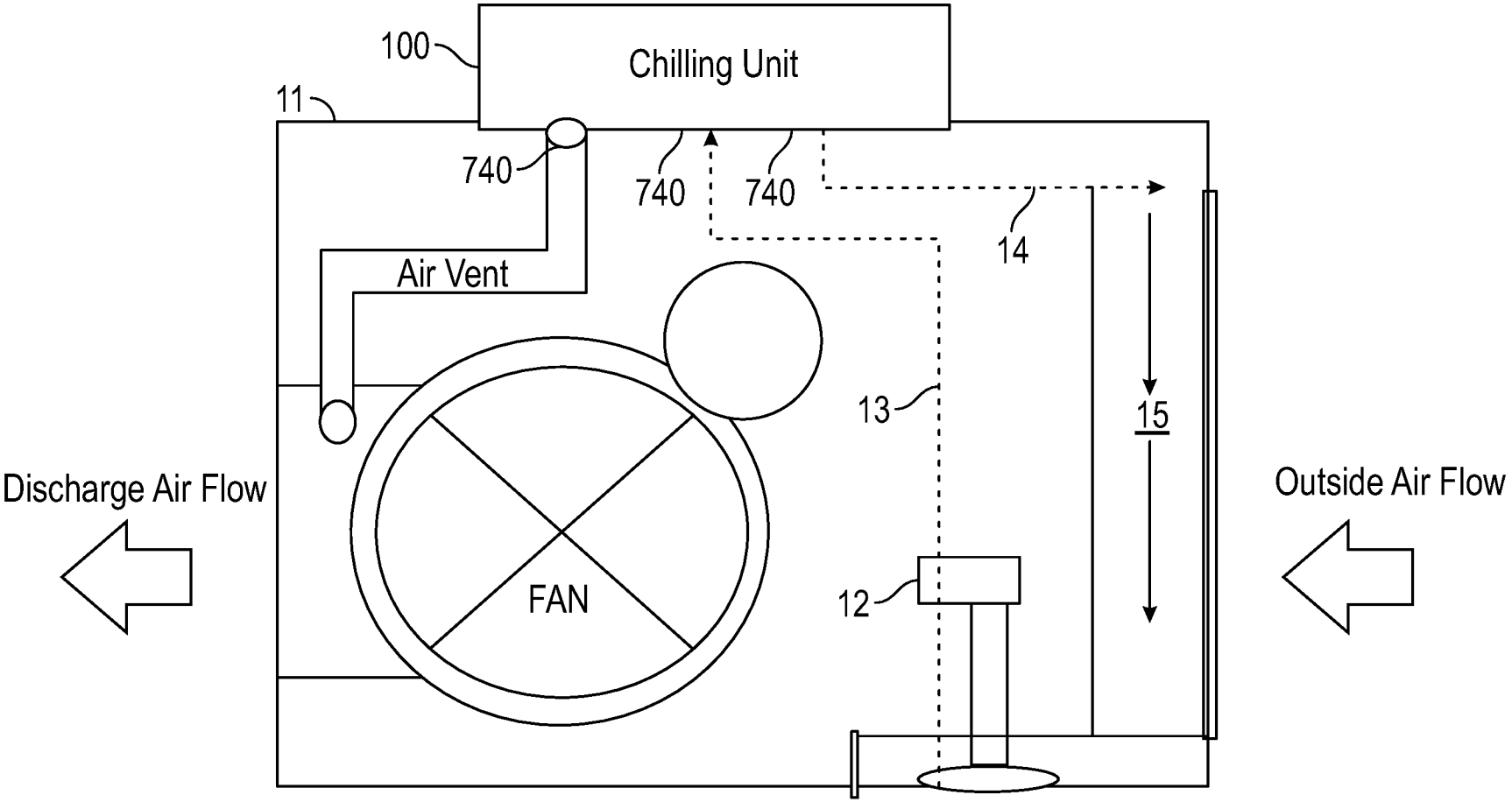
FIG. 5 is a schematic illustration showing how a chilling unit 100 retrofits and operates with an EAC 11 according to an embodiment of the present invention in which the chilling unit 100 is retrofit on top of EAC 11.
Figure 6:
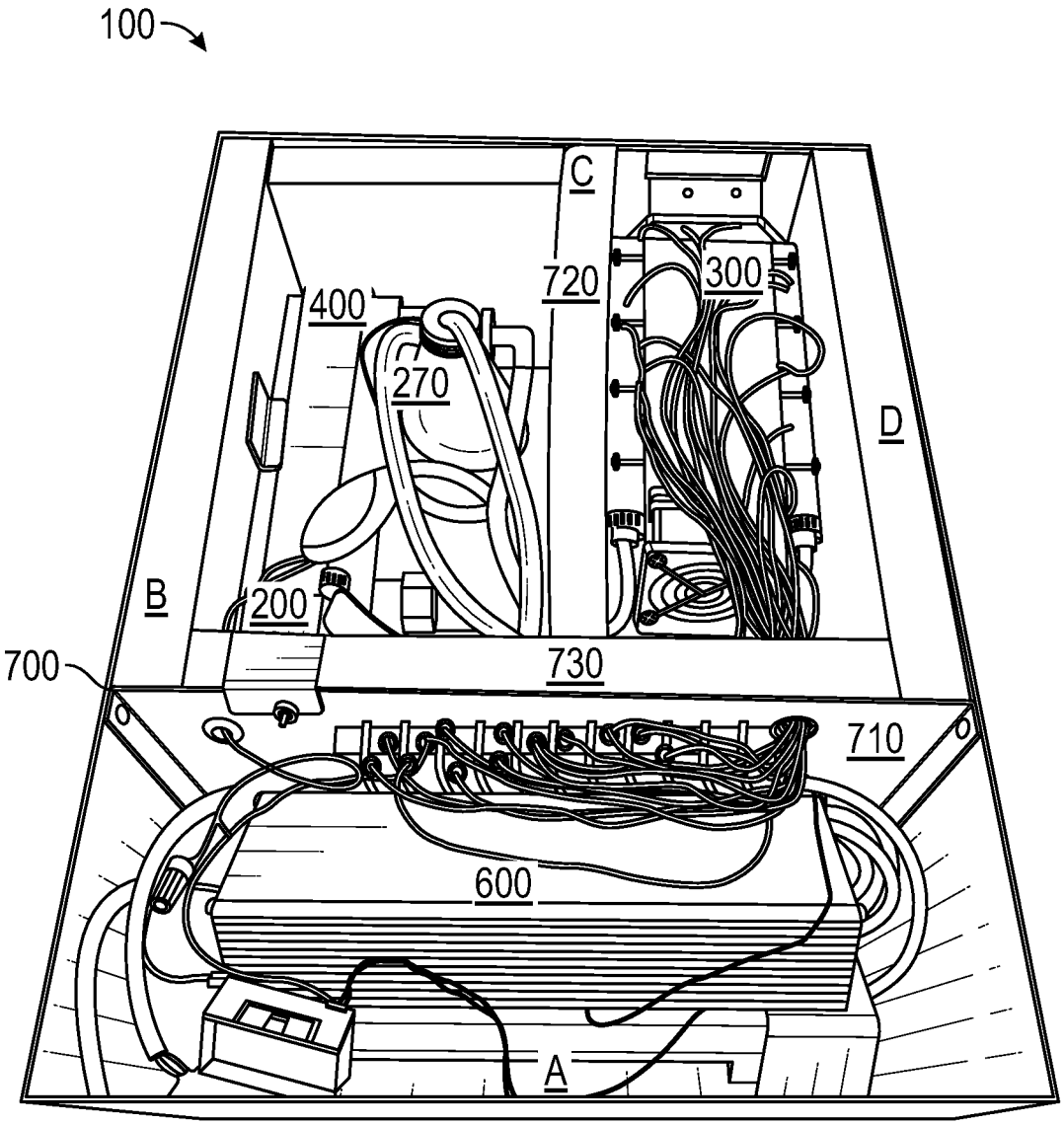
FIG. 6 is an illustration from a slightly angled top view of the inside of a chilling unit 100 according to an embodiment of the present invention.

In another embodiment of the present invention illustrated in FIGS. 4, 5 and 6 that employs a coolant. For purposes of this application, the term "coolant" means any fluid capable of transferring heat, including but not limited to ethylene glycol, propylene glycol, diethylene glycol, polyalkylene glycol, anything referred to as "antifreeze", freon, oil, and/or water and any combination thereof. Referring to FIG. 4, chilling unit 100 comprises coolant pump 200, chiller 300, heat exchanger 400, radiator 500 and coolant reservoir 270, all of which are connected by a series of coolant lines 210, 220, 230, 240, 250, and 260. Chilling unit 100 also preferably comprises power supply 600 providing electrical power to coolant pump 200 and chiller 300.

FIG. 4 illustrates a schematic diagram of the various components of chilling unit 100 according to an embodiment of the present invention and the direction of flow of coolant through the various components. Preferably, chilling unit 100 is a closed loop system of components receiving FDA approved coolant. Referring to FIG. 4, chilling unit 100 preferably comprises coolant pump 200 that pumps coolant from coolant reservoir 270 through coolant line 260 and 210 to first side 310 of chiller 300, then out first side 310 of chiller 300 through coolant line 220 to second side 320 of chiller 300, then out second side 320 of chiller 300 through coolant line 230 to coolant input 410 of heat exchanger 400, through heat exchanger 400 then out coolant output 420 of heat exchanger 400 through coolant line 240 to coolant input 510 of radiator 500, through radiator 500 then out coolant output 520 of radiator 500 through line 250 to be stored in coolant reservoir 270 until pump 200 again pumps the coolant out of coolant reservoir 270 into coolant line 260 to pump 200. In some embodiments, this exact series of coolant lines is not employed, where some components can be in fluid connection without the need for a coolant line. As used in this application, the term or phrase "in fluid connection" should be interpreted as broadly as possible and at least means that a fluid can flow from one object to the other, for example by being connected by a tube, line, or any other method of transporting fluids, or simply by being objects integrated together such that fluid pass through and/or to and from one to the other.

Referring to FIG. 4, power supply 600 preferably comprises a typical household power supply, including but not limited to a power source of 120 volts to 12 volt DC of 4 amps. In this way, chilling unit 100 can employ the existing power supplies/plugs made available for EACs. Power supply 600 provides electrical power to coolant pump 200 via wires 610 and to chiller 300 via wires 620. In some embodiments power supply 600 comprises various electrical components as may be necessary to convert or adapt power, including but not limited to adaptors, transformers, capacitors, etc.

Referring to FIG. 4, chiller 300 preferably comprises a cooling device that employs electricity to cool the coolant received via coolant line 210, including but not limited to thermoelectric cooling devices that employ the Peltier effect or other heat pumps, thermoelectric batteries, sold state refrigerators etc. In this way, electrical power, which is already made available by a typical EAC, is used to remove the heat from the coolant so that the coolant that exits chiller 300 is at a lower temperature than the coolant that entered it. The chilled coolant then passes into heat exchanger 400 via coolant input 410 where it will be used to remove heat from the water pumped into heat exchanger from the EAC. Referring to FIG. 4, water input 430 of heat exchanger 400 receives water from evaporative air conditioning unit 11 (EAC), preferably via supply water line 13 into which the water is pumped by the already existing water pump 12 of EAC 11 as shown in FIG. 2. Once in heat exchanger 400, the water from EAC 11 exchanges its heat with the coolant in heat exchanger 400, thereby cooling it. The water then exits heat exchanger 400 via chilled water output 440 and back into EAC 11 via chilled water discharge 140 to be employed within EAC 11 to moisten media 15 (for example, pads) for the evaporative air cooling process. It is noted that in the embodiment shown in FIGS. 4, 5 and 6, chiller 300 is in fluid connection with heat exchanger 400 in the sense that the coolant runs through both chiller 300 and heat exchanger 400 and passes from one to the other via coolant line 230. However, in such embodiment, chiller 300 is not necessarily in fluid connection with the water of water input 430 because the coolant takes heat from heat exchanger 400 but does not directly mix with water from water input 430.

Referring to FIG. 4, the coolant that has now received the heat from the water in heat exchanger 400 then exits heat exchanger 400 where it goes, via coolant line 240 into radiator 500 via coolant input 510 of radiator 500. In radiator 500, the coolant radiates out some of its heat before it exits radiator 500 at coolant output 520 to be delivered to and stored in coolant reservoir 270 via coolant tube 250.

Figure 7:
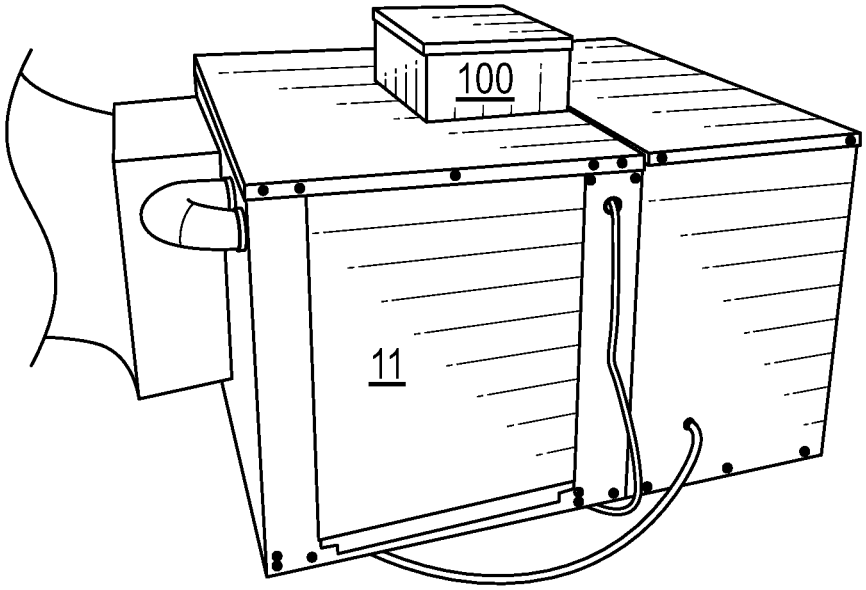
FIG. 7 is an illustration from a perspective view of a chilling unit 100 as retrofitted to an existing EAC 11, according to an embodiment of the present invention.

Chilling unit 100 is preferably a single unit, that is, all of its components are contained entirely with or at least partially within frame 700 of chilling unit 100. Referring to FIG. 6, coolant pump 200, chiller 300, heat exchanger 400, coolant reservoir 270, and coolant lines 210, 220, 230, 240, 250, and 260, are all contained entirely or at least partially within frame 700. The embodiment illustrated in FIG. 6 does not comprise a radiator, but in some embodiments, radiator 500 would also be contained within frame 700. In this way, chilling unit 100 is a modular unit separate from EAC 11 but retrofittable to EAC 11 and chilling unit 10 can be sold separately and simply installed on an EAC, for example, as illustrated in FIG. 7.

To further aid in modularity, chilling unit 100 preferably comprises walls 710 and 720 to separate and support the various components of chilling unit 100. Preferably, walls 710 ad 720 are formed of a rigid material, including but not limited to metal, metal allows, wood, foam, plastic, etc., so that components may be secured to it and/or it can hold its structure under the weight of the components or if shaken. To aid in describing the various locations and orientations of the components of chilling unit 100, chilling unit 100 may be referred to as comprising first side A, second side B adjacent to and clockwise from first side A, a third side C opposite first side A, and fourth side D adjacent to and clockwise from third side C and opposite second side B, as referenced in FIG. 6. Chilling unit 10 may be referred to as comprising a bottom, which surface would be the surface in contact with EAC 11 if chilling unit is resting on top of EAC 11 as appears in the illustrations, and a top, which is the surface opposite the bottom.

Referring to FIG. 6, power supply 600 is preferably oriented such that it is adjacent to first side A. Heat exchanger 400 is preferably adjacent to wall B. Chiller 300 is preferably adjacent to wall D. Wall 710, which in this case comprises metal, preferably separates power supply 600 from the other components, extending from side B to side D. Wall 720, comprising foam, preferably extends from about the center of the length of wall 710 to third side C, to separate chiller 300 from the other components.

Walls 710 and 720 preferably provide a support for the various components and a surface to which its various components can be secured. Other embodiments may have any number of walls, of any size and location, appropriate for the given size of the components of that particular chiller 100. Walls 710 and 720 and/or sides A, B, C, and/or D also comprise holes through which some or the coolant and/or water lines described herein can pass to extend between the different compartments formed by the walls. For example, referring to FIG. 5, the bottom of chilling unit 100 comprises holes 740 through which water lines 13 and 14 would pass to and from EAC 11 and/or air from the EAC can pass into chilling unit 100. Preferably chilling unit 100 rests on top of EAC 11 such that any holes 740 would be in its bottom, to prevent the elements from entering into chilling unit 100. In some embodiments, chilling unit 100 does not rest on top of EAC 11, but is secured to its side, or rests on the roof of the facility or ground adjacent to one of the sides of EAC 11, which case holes 740 are preferably disposed on side A, B, C or D, or the top, of chilling unit 100.

Chilling unit 100 also preferably comprises stuffing material 730 to assist in providing support for its various components. Stuffing material 730 is preferably a foam material glued to the inside surfaces and walls 710 and 720 of chilling unit 100 or forming walls 710 or 720 themselves. In some embodiments, stuffing material 730 comprises Styrofoam, cardboard, wood, metal and/or any other rigid material, and/or any combination thereof.

Figure 8:
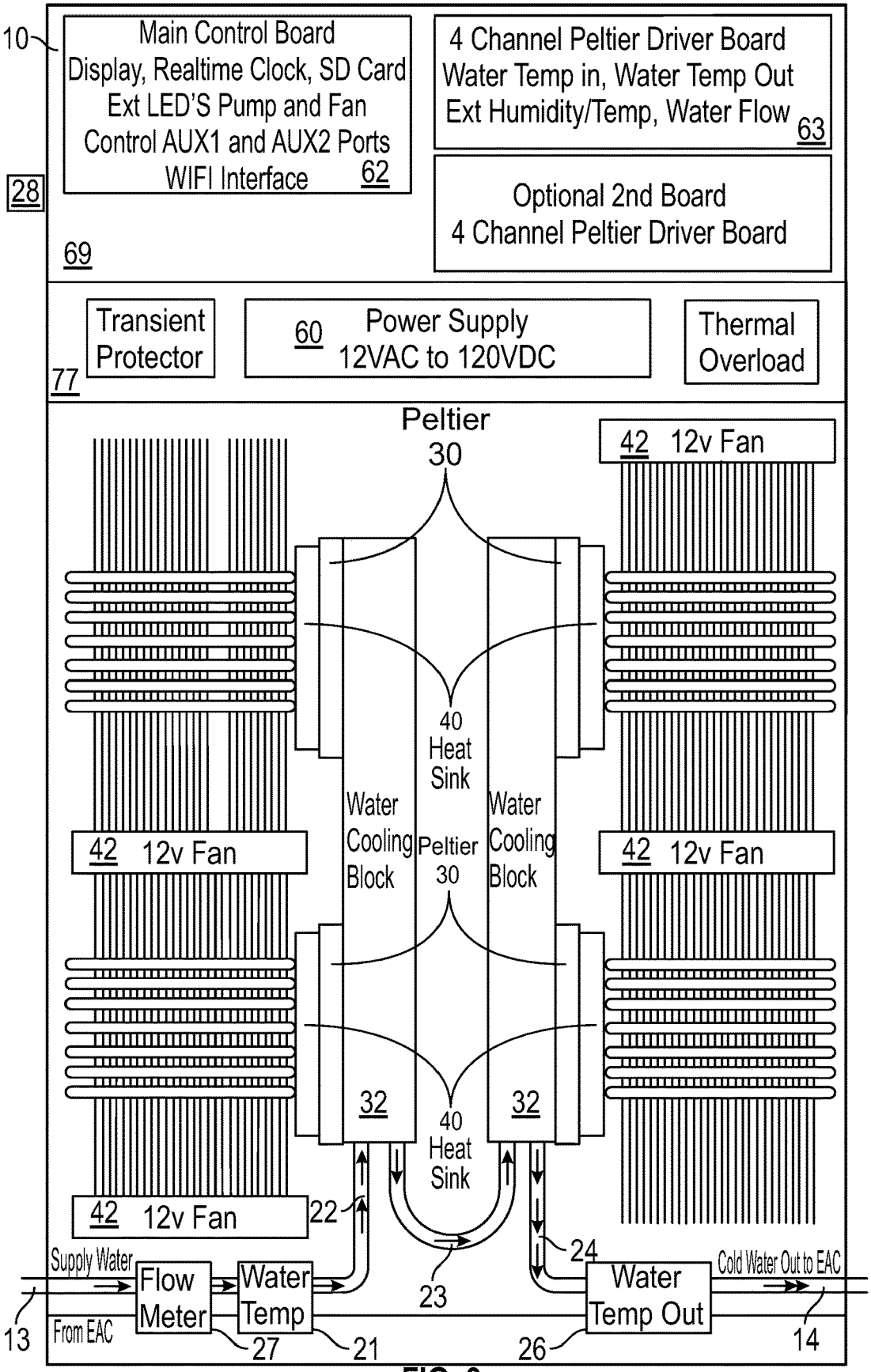
FIG. 8 is a schematic illustration showing the various components and direction of flow of water in a chilling unit 10 according to an embodiment of the present invention.
Figure 9:
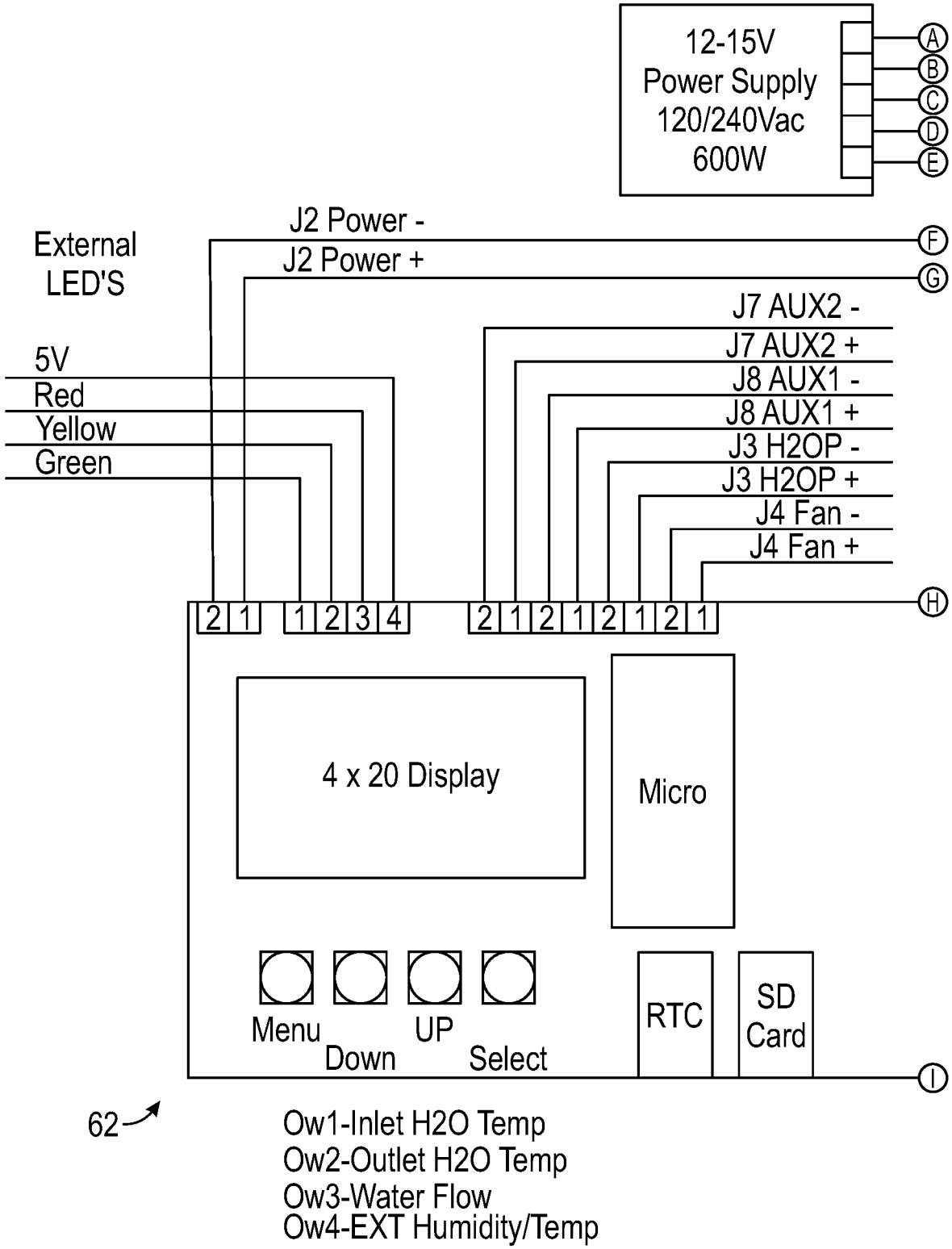
FIG. 9 is an electrical diagram of a chilling unit 10 illustrated in FIG. 8, according to an embodiment of the present invention.
Figure 9:
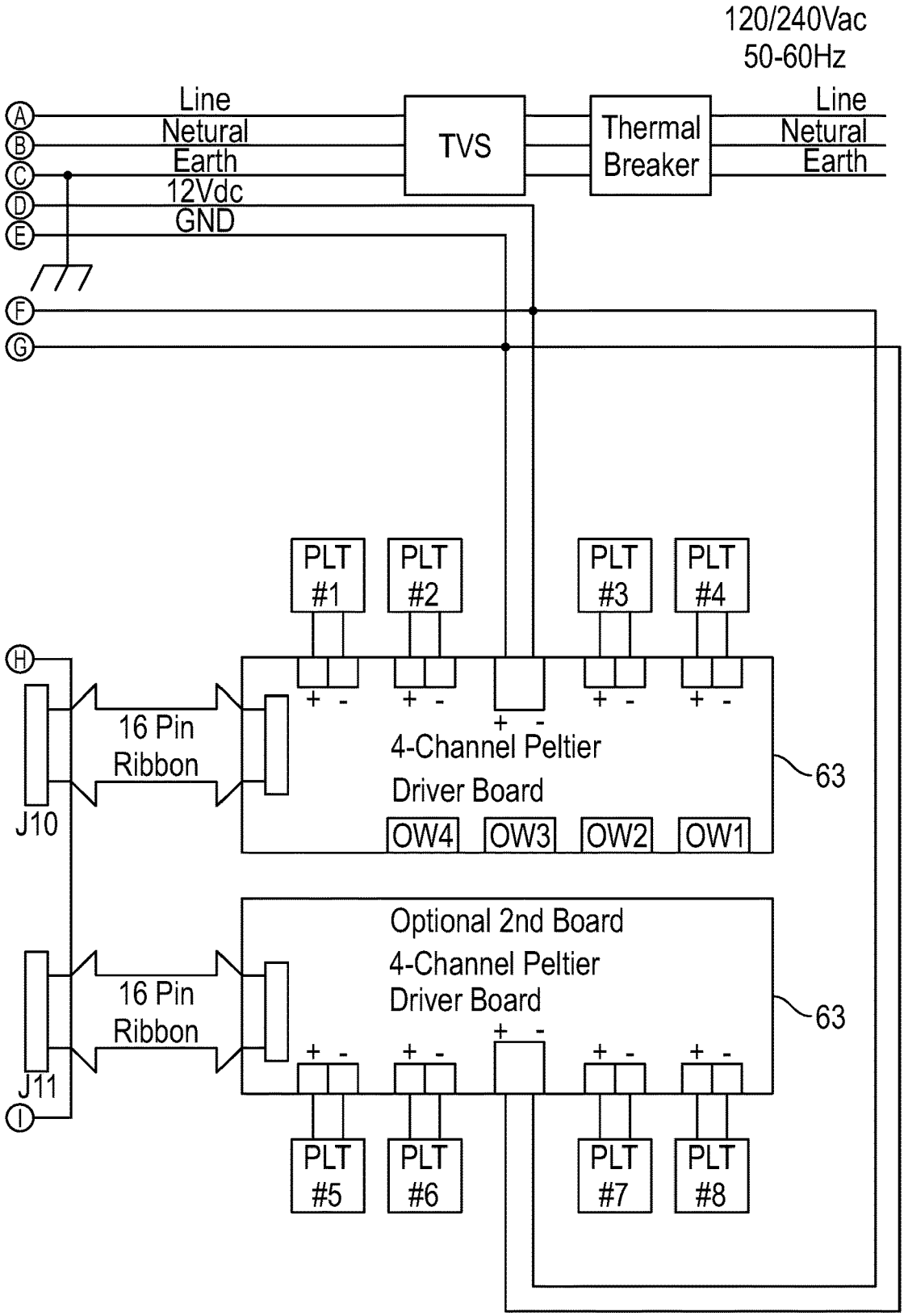

FIG. 8 illustrates yet another embodiment of chilling unit 10 according to the present invention. Referring to FIG. 8, chilling unit 100 also preferably comprises a control system 69 in electrical connection with power supply 60 in power section 77. Control system 69 receives data or signals from inlet water temperature sensors 21, the water flow meter 27, and an external humidity/temperature sensor and in turn controls the four channel Peltier driver board 63, including by turning the chillers 30 off and on and adjusting power to chiller 30 from zero power to full power, based on instructions in its programming. That control system 69 programming implements the processes described herein, including the following processes.

The system may run in several variations of the basic operational mode dependent on application.

In one embodiment, the system runs only when the electronics are powered, waiting for the ambient air temperature from ambient sensor 28 to reach a preset temperature and/or the inlet water temperature sensor 21 has exceeded a temperature set point. If that occurs A/C Pump 12 is turned on and water flow meter 27 is monitored. If the flow rate of the water flow meter 27 is above a preset value, about five minutes after the A/C Pump 12 starts, fans 42 (which may be disposed on, at, or directed at either or both of heat sink 40 or chiller 30) are turned on. Water inlet temperature 21 and outlet water temperature 26 of the water cooling blocks 32 and the heat sink 40 is monitored, and power is applied to heat exchanger chillers 30 at a slow rate. The difference between the inlet water temperature sensor 21 and outlet water temperature sensor 26 will increase, a larger positive delta temperature, with increasing power of chillers 30. When the desired delta T in temperature reaches a preset value, control system 69 acts to maintain that value by increasing or decreasing (including in discrete increments) the power level of chillers 30. Control continues with this action until the ambient air temperature from the humidity/temperature sensor 28 falls below its preset temperature, or the inlet water temperature sensor 21 falls below it preset low temperature. At that time power is removed from chillers 30, and about five minutes later, the fans and pumps are turned off. When again the ambient temperature (external humidity/temperature sensor 28) goes above the preset value, or the inlet water temperature sensor 21 goes above its preset value the cycle of events repeats.

The physical elements of control system 69 include sensors to monitor ambient humidity/temperature and inlet water temperature at sensor 21, outlet water temperature at sensor 26, water flow rate at flow meter 27, and voltages and currents at chillers 30. Together with power devices to turn on and off fans 42, pumps 12 and 200, and with fine control of the power to chiller devices 30 are run by the control software in a microcontroller on the main control board 62.

Preset values for the inlet water temperature sensor 21, the external humidity/temperature sensor 28, the outlet water temperature sensor 26, and the desired delta temperature (delta T) of the inlet water temperature sensor 21 and the outlet water temperature 26 are all adjustable in software manually or may be adjusted by software algorithm based on data collected and best conditions saved by data logger, as operated by control system 69.

When powered on, water stored in the existing reservoir 16 of EAC is pumped by EAC water pump 12 via supply water line 13 into chilling unit 10, as illustrated in FIG. 2. Preferably, supply water line 13 is connected to the output side of EAC water pump 12. Referring to FIG. 8, inlet water temperature 21, preferably comprising an OW (one wire thermal electric sensor) or other temperature sensor disposed at, near or in a thermal well where supply water line 13 enters chilling unit 10 and is electrically connected to the main control board 62 via the four-channel driver board 63. Main control board 62 monitors the temperature of the water in supply water line 13. The micro on the main control board 62 and the driver board 63 is activated when inlet water temperature sensor 21 does not meet a pre-set minimum temperature, thereby energizing chillers 30 by power supply 60. Main control board 62 through software controls turn on four PWM (pulse width modulated) signals on the Peltier driver board 63, which drives four Peltier driver circuits that energize the four Peltier's to a desired level to meet the cooling requirements. After leaving or passing the inlet water temperature sensor 21, the water passes through line 22 into water block 32. Water block 32 preferably comprises a solid aluminum structure comprising a plurality of internal channels allowing the water to go back and forth within it, including but not limited to a radiator. Each water block 32 is preferably attached to or otherwise comprises water lines connected with, at least one chiller 30. As the water moves through the two or more water blocks 32, it is cooled. This process is repeated until the water temperature is below a preset temperature which can be preset or adjusted by the micro for optimal cooling under current operational parameters. Once the temperatures meets that preset temperature, the micro turns down or turns off the two chillers 30. Temperature sensors electrically connected to the main control board 62 via the four channel driver board 63 are preferably disposed at or near where supply water line 13 enters chilling unit 10 (for example, inlet water temperature sensor 21) and disposed at or near water blocks 32, including in water blocks 32, water lines 23 and 24 and/or at the outlet water temperature sensor 26. Preferably, chilling unit 10 comprises flow regulation of water flow by measuring the water flow with a water flow meter 21 and by the main control board 62 controlling the speed of the A/C pump 12 in FIG. 2. Water leaves chilling unit 10 into output water line 14 and back into EAC 11. Preferably, output water line 14 is disposed in or above EAC reservoir 16. That chilled water simply falls into the water reservoir 16 of EAC 11 to be used to moisten media 15. Preferably, water flows through chilling unit 10 even when power supply 60 is not energizing chillers 30. The main control board 62 via the four channel driver board 63 also can read the outlet water temperature sensor 26 and can measure a value for the delta temperature between the inlet water temperature sensor 21 and the outlet water temperature sensor 26. This delta water temperature can help find desired optimal operations for the system.

The methods and processes described herein can be embodied as programming or software operating in control system 69. Optionally, embodiments of the present invention can include a general or specific purpose computer or distributed system programmed with computer software implementing steps described above, which computer software may be in any appropriate computer language, including but not limited to C++, FORTRAN, BASIC, Java, Python, Linux, assembly language, microcode, distributed programming languages, etc. The apparatus may also include a plurality of such computers/distributed systems (e.g., connected over the Internet and/or one or more intranets) in a variety of hardware implementations. For example, data processing can be performed by an appropriately programmed microprocessor, computing cloud, Application Specific Integrated Circuit (ASIC), Field Programmable Gate Array (FPGA), or the like, in conjunction with appropriate memory, network, and bus elements. One or more processors and/or microcontrollers can operate via instructions of the computer code and the software is preferably stored on one or more tangible non-transitive memory-storage devices. All computer software disclosed herein may be embodied on any non-transitory computer-readable medium (including combinations of mediums), including without limitation CD-ROMs, DVD-ROMs, hard drives (local or network storage device), USB keys, other removable drives, ROM, and firmware.

Anything described herein as "electrical connected" or in electrical connection should be interpreted as broadly as reasonable, and shall include wireless or other electromagnetic connections.

Embodiments of the present invention can include every combination of features that are disclosed herein independently from each other. Chilling units 10 and 100 as described herein should be considered as comprising the same features as each other unless such feature is not compatible with that particular embodiment. Although the invention has been described in detail with particular reference to the disclosed embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference. Unless specifically stated as being "essential" above, none of the various components or the interrelationship thereof are essential to the operation of the invention. Rather, desirable results can be achieved by substituting various components and and/or reconfiguration of their relationships with one another.

Note that in the specification and claims, "about" or "approximately" means within twenty percent (20%) of the numerical amount cited.

What is claimed is:

1. A method of retrofitting an evaporative air conditioning unit with a chilling unit, the method comprising:

providing a chilling unit comprising:

a frame, the frame comprising a bottom side and a top side opposite the bottom side; and a power supply;

supplying water, via a water supply line, from the evaporative air conditioning unit;

fluidly connecting a water block with the water supply line;

placing a thermoelectric cooling device in heat exchange connection with the water block;

electrically connecting the thermoelectric cooling device with the power supply;

containing the power supply, water block and thermoelectric cooling device at least partially within the frame;

fluidly connecting a water pump in the evaporative air conditioning unit to the water supply line, through an interface on the bottom side of the frame;

cooling, with the thermoelectric cooling device, water in the water block;

directing a water output from the water block through an interface on the bottom side of the frame and toward the evaporative air conditioning unit;

connecting the power supply via a cable to a power source on the evaporative air conditioning unit, through an interface on the bottom side of the frame; and disposing the frame on the evaporative air conditioning unit such that the bottom side of the frame faces or contacts a surface of the evaporative air conditioning unit.

2. The method of claim 1, wherein the frame comprises:

the interface on its bottom side of a size to receive the water supply line and/or the cable;

an air vent on a side thereof; and wherein the chiller is a thermoelectric cooling device employing the Peltier effect.

3. The method of claim 1, further comprising:

detecting, with a first temperature sensor, the temperature of supply water within the water supply line; and turning on power to the thermoelectric cooling device when the temperature of the supply water is above a first preset temperature, and turning off the power to the thermoelectric cooling device when the temperature of the supply water is below a second preset temperature.

4. The method of claim 3, further comprising:

detecting, with a second temperature sensor, the temperature of water in a water output line for passing water from the chilling unit to the evaporative air conditioning unit; and disposing externally of the frame an ambient air temperature and/or humidity sensor.

5. The method of claim 1 wherein:

placing a thermoelectric cooling device comprises placing a series of thermoelectric cooling devices; and fluidly connecting a water block comprises fluidly connecting a series of water blocks.

6. The method of claim 1, further comprising:

providing the thermoelectric cooling device with a heat sink;

directing a fan at the heat sink; and disposing a vent within the frame where the fan is located.

7. The method of claim 6, further comprising:

placing the thermoelectric cooling device in heat exchange connection with the heat sink; and allowing water to flow back and forth through a plurality of internal channels in the water block.

8. A method of retrofitting an evaporative air conditioning unit with a chilling unit, the method comprising:

providing a chilling unit comprising a frame;

disposing the frame upon the evaporative air conditioning unit;

supplying water, via a water supply line, from the evaporative air conditioning unit to a water block within the frame;

placing within the frame a thermoelectric cooling device in heat exchange connection with the water block;

electrically powering the thermoelectric cooling device;

fluidly connecting the water supply line to a water pump in the evaporative air conditioning unit;

cooling, with the thermoelectric cooling device, water in the water block; and discharging, via an output water line, a water output from the water block toward the evaporative air conditioning unit.

9. The method of claim 8 further comprising:

sensing a temperature of water in the water supply line;

sensing a temperature of water in the output water line; and increasing or decreasing electrical power to the thermoelectric cooling device based on a difference in temperature between the temperature of the water in the water supply line and the temperature of the water in the output water line.

10. The method of claim 8 further comprising employing the Peltier effect in the thermoelectric cooling device.

11. The method of claim 8, further comprising:

detecting, with a first temperature sensor, the temperature of supply water within the water supply line; and turning on power to the thermoelectric cooling device when the temperature of the supply water is above a first preset temperature, and turning off the power to the thermoelectric cooling device when the temperature of the supply water is below a second preset temperature.

12. The method of claim 8, further comprising:

providing the thermoelectric cooling device with a heat sink; and directing a fan at the heat sink.

13. The method of claim 12, further comprising:

detecting, with a second temperature sensor, the temperature of water in the water output line;

sensing, with an ambient sensor disposed externally of the frame, ambient air temperature; and when the ambient air temperature reaches a preset air temperature, or when the temperature of supply water within the water supply line exceeds a third preset temperature:

turning on the water pump in the evaporative air conditioning unit; and monitoring with a meter a water flow rate in the water supply line.

14. The method of claim 13, further comprising, after turning on the water pump in the evaporative air conditioning unit and when the water flow rate in the water supply line exceeds a preset flow value, turning on the fan at the heat sink.

15. The method of claim 14, further comprising running the fan until the ambient air temperature falls below the preset air temperature or the temperature of supply water within the water supply line falls below the third preset temperature.

* * * * *